US005432759A

United States Patent [19]

Vaucher

[11] Patent Number: 5,432,759

[45] Date of Patent: Jul. 11, 1995

[54] ANNUAL CALENDAR MECHANISM FOR A TIMEPIECE

[75] Inventor: Frank Vaucher, Cormoret, Switzerland

[73] Assignee: Compagnie des Montres Longines, Francillon S.A., St-Imer, Switzerland

[21] Appl. No.: 273,706

[22] Filed: Jul. 12, 1994

[30] Foreign Application Priority Data

Jul. 15, 1993 [CH] Switzerland ..... 02139/93

[51] Int. Cl.[6] ..... G04B 19/24

[52] U.S. Cl. ..... 368/28; 368/37

[58] Field of Search ..... 368/28, 35, 37, 38

[56] References Cited

U.S. PATENT DOCUMENTS

| | | | |
|---|---|---|---|
| 4,541,725 | 9/1985 | Baumgartner et al. | 368/37 |
| 4,674,889 | 6/1987 | Klaus | 368/28 |
| 4,974,242 | 11/1990 | Vuilleumier | 368/37 |
| 5,235,562 | 8/1993 | Vaucher | 368/28 |

FOREIGN PATENT DOCUMENTS

| | | |
|---|---|---|
| 57935 | 9/1953 | France . |
| 680630GA3 | 10/1992 | Switzerland . |
| 2011663 | 7/1979 | United Kingdom . |

*Primary Examiner*—Vit W. Miska
*Attorney, Agent, or Firm*—Sughrue, Mion, Zinn, Macpeak & Seas

[57] ABSTRACT

The annual calendar mechanism includes a calendar driving wheel (18) provided with a finger (17) adapted to drive a date wheel (19) through one step at the end of each month. An annual wheel (25), driven through two steps once per month by a long tooth (23) borne by an intermediate wheel (21), itself meshing with the date wheel (19), includes a plate (27) bearing five teeth (28). If one of these five teeth, corresponding to one of the months of less than thirty-one days, comes into the path of finger (17), the annual wheel, from being driven, becomes driving and drives the date wheel through an additional step via the intermediate wheel.

7 Claims, 8 Drawing Sheets

ANNUAL CALENDAR MECHANISM FOR A TIMEPIECE

The present invention concerns an annual calendar mechanism for a timepiece, such calendar displaying for example through a window pierced in a dial or by divisions applied onto a dial in regard to which a hand points. Such mechanism includes a calendar driver wheel set making one rotation in twenty-four hours, said wheel set being fitted with at least one finger adapted to drive a date wheel including thirty-one teeth through one step once each day, said date wheel operating the calendar display.

BACKGROUND OF THE INVENTION

A calendar mechanism answering generally to the definition which has just been given is known for example from patent documents CH-A-538 136 and CH-A-661 171 (U.S. Pat. No. 4,676,659). In these documents, there is also found a twenty-four hour calendar driving wheel provided with a finger or a long tooth which drives a date disc bearing thirty-one indications. However, the finger does not directly drive the disc, but rather an intermediate wheel set which itself drives such disc. There, to be sure it concerns an ordinary non-perpetual calendar mechanism. At the end of months of thirty days and at the end of the month of February, it is then necessary to effect a manual correction should one not wish to lose the date.

Perpetual calendar mechanisms have already long been known in which an arrangement automatically controls all changes, whether concerning months including 28, 29, 30 or 31 days. Such mechanisms are described in detail in the work entitled "Les montres-calendrier modernes" of B. Humbert—Editions Scriptar S. A. Lausanne 1953 (English language version: "Modern Calendar Watches", Lausanne 1954). Thus, a perpetual calendar watch does not require manual correction of the date display at the end of months counting fewer than thirty-one days. Likewise, every four years upon the occasion of the leap year and in the month of February, the watch will display the figure twenty-nine before indicating the first of March.

Without going into the details, here there will be mentioned a mechanism using a month cam making one rotation in four years. Such cam exhibits notches which are more or less deep: the full portions correspond to the months of thirty-one days; the shallow notches to the months of thirty days; three very deep notches to the months of February in the common years (twenty-eight days) and the notch of intermediate depth to the month of February in the leap year. On such cam there acts the beak of a lever urged by a spring. The depth of penetration of the beak will determine which advance must be impressed on the date indicator at the end of each month.

The mechanism briefly evoked hereinabove uses levers and return springs which lead to a relatively complicated construction which necessitates in turn a relatively high number of parts. On the other hand, it can be mentioned that such mechanisms do not always show reliable operation, particularly if shocks are applied to the timepiece.

To obviate the cited drawbacks, the present invention proposes to place gears only into operation and to exclude all levers or rocking bars, such gears on the one hand being prevented from all untimely rotation, even if shocks are applied to the timepiece and, on the other hand, showing a clearly simplified design and one of reduced height, this being even more so the case since the calendar of the invention is limited to the automatic advance of the date for the months of thirty days only, the resetting of the date having to be manually effected at the end of the month of February. Hence, it concerns an annual and not a perpetual calendar.

SUMMARY OF THE INVENTION

To attain this purpose, the annual calendar mechanism according to the present invention is characterized by the fact that the date wheel drives an intermediate wheel including thirty-one teeth, thirty of which are truncated, the non-truncated tooth driving a first plate of an annual wheel bearing twenty-four teeth once per month through two steps, such annual wheel comprising a second plate fixed thereto and superposed thereon bearing five teeth, each corresponding to months of less than thirty-one days, each of such teeth being arranged so as to come into the path of the finger of the date driver wheel set at the end of the cited months so as to drive the annual wheel through one step, which has as consequence the driving of the date wheel through an additional step via said intermediate wheel at the end of said months.

The invention will now be explained with the help of the description which follows and drawings which illustrate it by way of example.

DESCRIPTION OF THE PREFERRED EMBODIMENT

Figure 1:
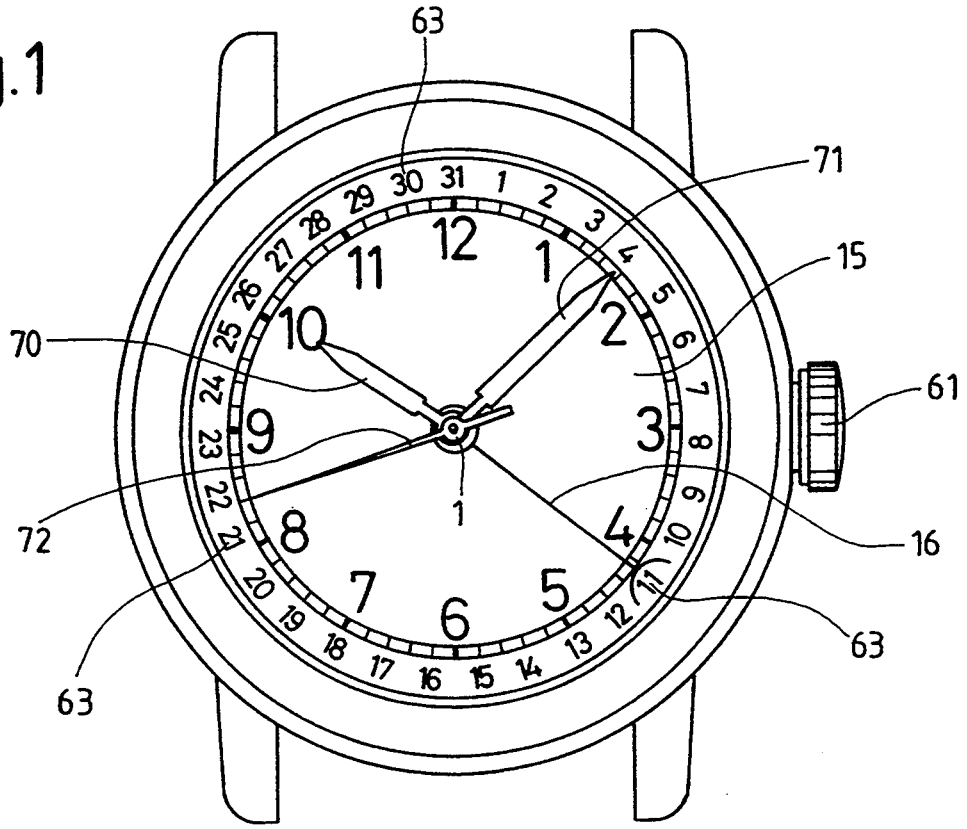
FIG. 1 is a plan view of a watch showing a calendar using a hand according to a first simplified embodiment of the invention.

The plan view of FIG. 1 shows a watch fitted out, apart from the hours hand 70, minutes hand 71 and seconds hand 72, with a date hand 16 indicating dates 63 distributed uniformly around a dial 15. Time setting can be effected by means of the crown 61. This embodiment will not bring about appearance either of the day or of the month and its thus simplified mechanism appears on FIG. 2. This simplified embodiment has been chosen in order to explain the invention in its basic aspects, but it will be observed that without the months display, it would be difficult to set a calendar of a watch which had been stopped for a long time. It thus concerns here a teaching matter chosen in order to describe easily the basis of the invention.

Figure 2:
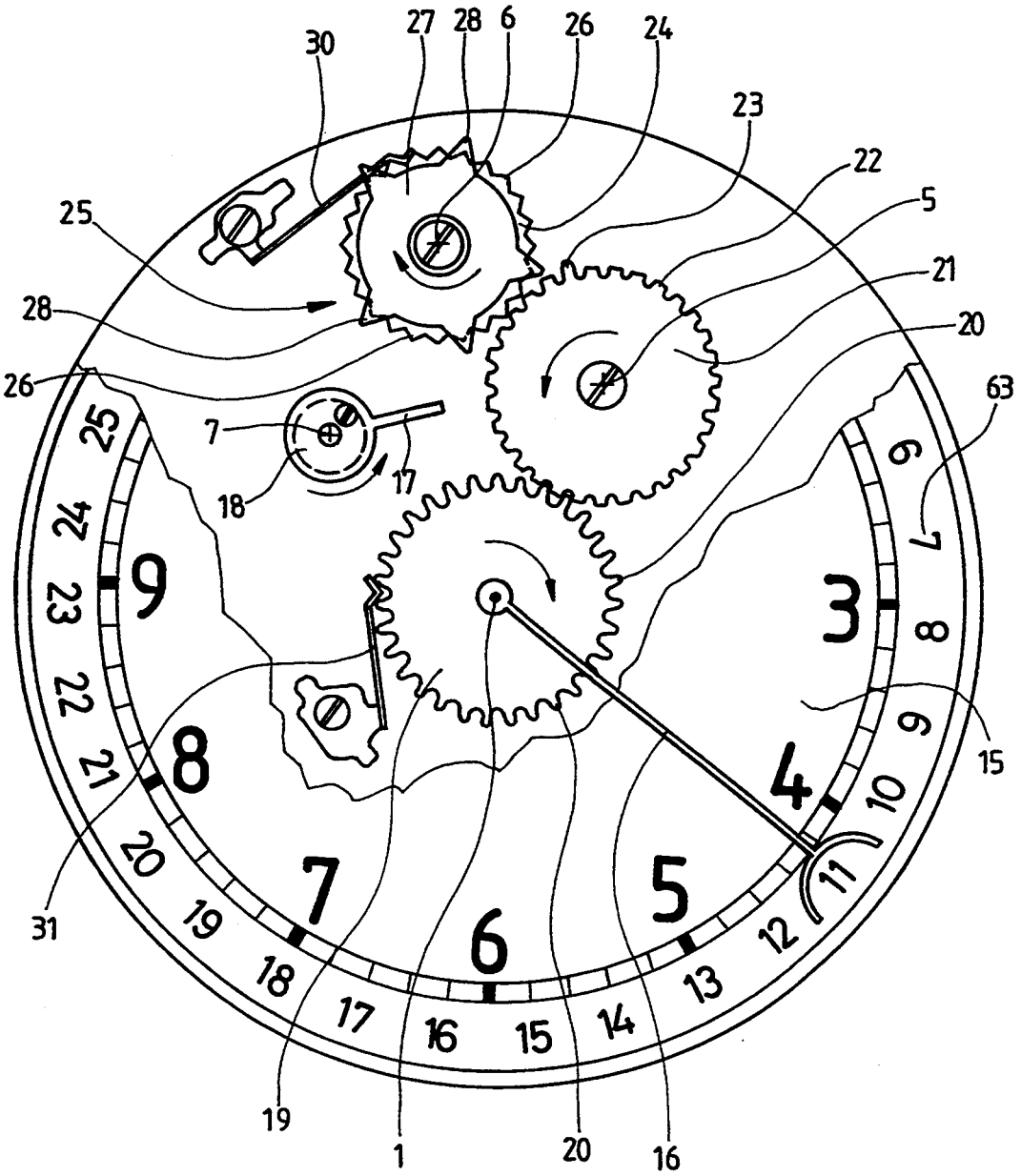
FIG. 2 is a plan view of the date mechanism fitting out the watch of FIG. 1.

The mechanism of FIG. 2 mainly shows four wheel sets which entirely define the invention, namely a calendar driving wheel set 18, a date wheel 19, an intermediate wheel 21 and an annual wheel 25. The arrows show the rotation sense of the wheel sets in respect of each of them.

The calendar driving wheel set 18 makes one revolution in twenty-four hours and is actuated by a standard or electronic timepiece movement which is located under the plane of FIG. 2 and is thus not apparent. To such wheel set 18 is attached a finger 17, adapted to drive the date wheel 19 including thirty-one teeth 20 through one step and once per day. FIG. 2 shows that the date wheel 19 bears directly the date hand 16 which could be replaced by a date disc the indications of which would appear through a window or which could actuate a fly-back calendar system as will appear hereinafter. In turn, the date wheel 19 drives the intermediate wheel 21 which bears thirty-one teeth, thirty 22 of which are truncated. The thirty-first non-truncated tooth 23 drives a first plate 24 of an annual wheel 25 bearing twenty-four teeth 26 and causes such annual wheel 25 to advance through two steps once per month. On this first plate 24 is mounted fixed and superposed thereover a second plate 27 which bears five long teeth 28, each corresponding to months of less than thirty-one days, namely the month of February, April, June, September and November (refer also to FIG. 11). It is arranged so that each of such teeth 28 are in the path of finger 17 of the calendar driving wheel set 18 and this at the end of the months which have just been cited. Accordingly the annual wheel is driven through one step which has as result to drive the date wheel 19 through one additional step at the ends of the cited months of thirty days via the intermediate wheel 21. Thus, the annual wheel 25 which normally is driven once per month by intermediate wheel 21 becomes a driving wheel through the action of finger 17 and causes the date wheel 19 to advance through one step.

FIG. 2 also shows that a jumper spring 30 is arranged over teeth 26 of the first plate 24 of the annual wheel 25, initially in order to position it angularly when it is not actuated, then to prevent it from turning when it is not engaged either with finger 17 or with the non-truncated tooth 23. On the same FIG. 2, it is also seen that a jumper spring 31 is arranged over the teeth 20 of the date wheel 19 in order to position it angularly when it is not actuated, this permitting perfect indexation of the date hand 16 opposite the date indications 63.

Figure 3:
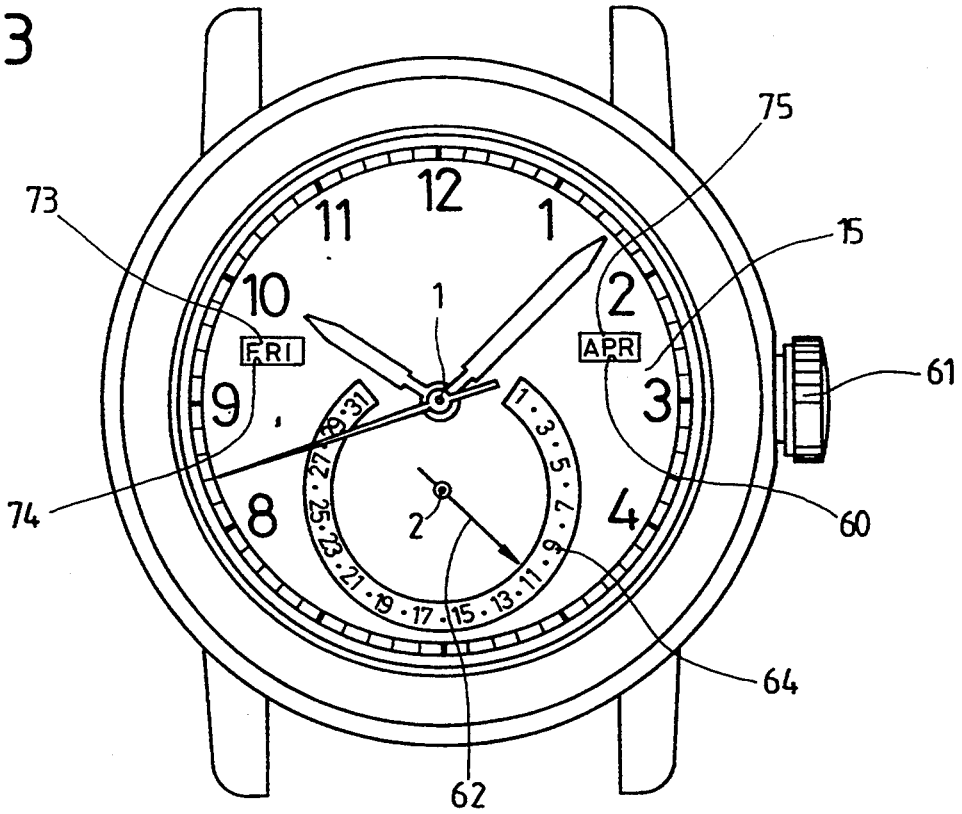
FIG. 3 is a plan view of a watch showing a calendar with a fly-back hand and with display of the days and months according to a second more complete embodiment of the invention.

A second embodiment of the invention is shown on FIG. 3 to which corresponds the mechanisms of FIGS. 4 to 10. Such second embodiment is distinguished from the first by the fact that it includes displays of the day 73 and of the month 75, a calendar driving wheel set 18 bearing two fingers 17 and 41 and accessory thereto, a fly-back date hand 62. As is seen on FIG. 3, the day indication 73 appears in a window 74 and the month indication 75 in a window 60. The days 73 and months 75 are applied respectively to discs 37 and 32 which appear without indication on FIGS. 4 to 7.

FIGS. 4 to 7 show the annual calendar mechanism at different occasions, namely the 30th of April at 23:00 hours to the 31st of May which occasions will be reviewed hereinafter. There will now be defined what these figures have in common.

As on FIG. 2, there is found on FIGS. 4 to 7 the calendar driving wheel 18 (axis 7), the date wheel 19 (axis 1), the intermediate wheel 21 (axis 5) and the annual wheel 25 (axis 6). It will be observed that the mechanism includes a months display comprising a star 33 having twelve teeth 34 (axis 3), indexed by a jumper spring 35. Star 33 bears the months disc 32, the indications 75 of which (not shown on FIGS. 4 to 7) appear in the window 60 visible on FIG. 3. The star 33 is actuated once per month by a finger 36 fixed to the intermediate wheel 21. There will be further observed that the mechanism includes a display of the week days comprising a star 38 with seven teeth 39 (axis 4) indexed by a jumper spring 40. Star 38 bears the days disc 37 the indications 73 of which (not shown on FIGS. 4 to 7) appear in window 74 visible on FIG. 3. Star 38 is actuated once per day by finger 17 of the calendar driving wheel set 18. Thus such finger 17, in rotating, initially causes advancement of the date wheel 20 through one step in pushing one of the teeth 20 of said wheel, then next causes the star 38 to advance by one step in pushing one of the teeth 39 of said star.

As already evoked hereinabove, the calendar driving wheel set 18 bears a second raised-up finger 41 (see cross-section of FIG. 8) intended to drive teeth 28 of the second plate 27 of the annual wheel 25. In this design, the angle between the two fingers is on the order of 75° and has as purpose a rapid passage from the 30th of a month of thirty days to the 1st of the following month, while in the embodiment of FIG. 2 including only one finger, several hours are necessary in order to bring about such passage over two time periods.

It has already been mentioned that the second embodiment exhibits a fly-back calendar system. Here it concerns an arbitrary choice foreign to the present invention, such calendar possibly employing a hand over 360° or again a window. Such fly-back calendar shows a wheel 43 fixed and coaxial to the date wheel, 19 the teeth 44 of which mesh with the teeth 52 of a fly-back wheel 51 (axis 2) returned by spiral spring 53. The fly-back wheel 51 is held in place by a plate 50 which is traversed by axis 2 on which the date hand 62 is hafted (see also cross-section of FIG. 10). Such a mechanism has been described in the patent application CH-A-681 761 in the name of the same applicant. It is thus here unnecessary to return to it.

FIGS. 4 to 7 show finally that the mechanism is provided with a rapid correction system 42 for the calendar indication. Such system, known of itself, includes a first pinion 56 (axis 9) actuated by the crown 61 of the timepiece. Such pinion is in mesh with a second sliding pinion 54 (axis 8) the teeth of which mesh with the teeth 20 of the date wheel on condition that the crown be driven in a predetermined sense. If the crown is driven in the inverse sense, the sliding pinion 54 is disengaged from teeth 20. The figures show that pinion 54 is held up by a blade 55 secured to the base plate by a screw 14.

FIGS. 4 to 7 will now be passed in review one by one in order to explain the operation of the annual calendar. The arrows placed on FIG. 4 indicate in which sense each of the wheel sets rotates.

Figure 4:
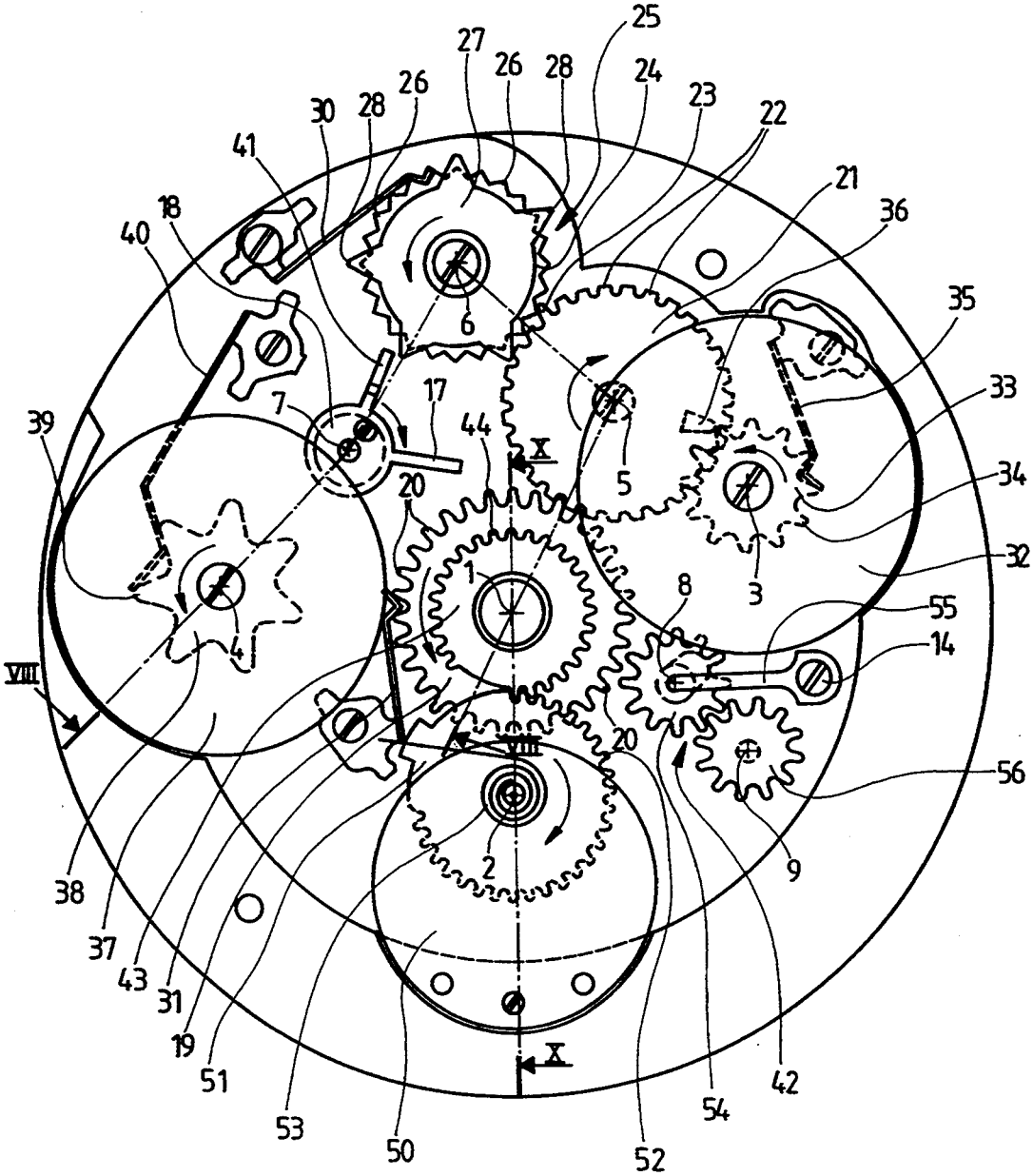
FIG. 4 is a plan view of a calendar mechanism fitting out the watch of FIG. 3 showing the position of the wheels on 30th April at 23:00 hours.

FIG. 4 shows the position of the mechanism the 30th of April at 23:00 hours. The date hand indicates the 30th of April. Finger 41 of the driving wheel set 18 appears in the path of a long tooth 28 of the second plate 27 of the annual wheel 25. The non-truncated tooth 23 of the intermediate wheel 21 bears on the side of one of the teeth 26 of the first plate 24 of the annual wheel 25. Finger 36 of the intermediate wheel 21 penetrates between two teeth 34 of star 33. Disc 32 displays the month of April.

Figure 5:
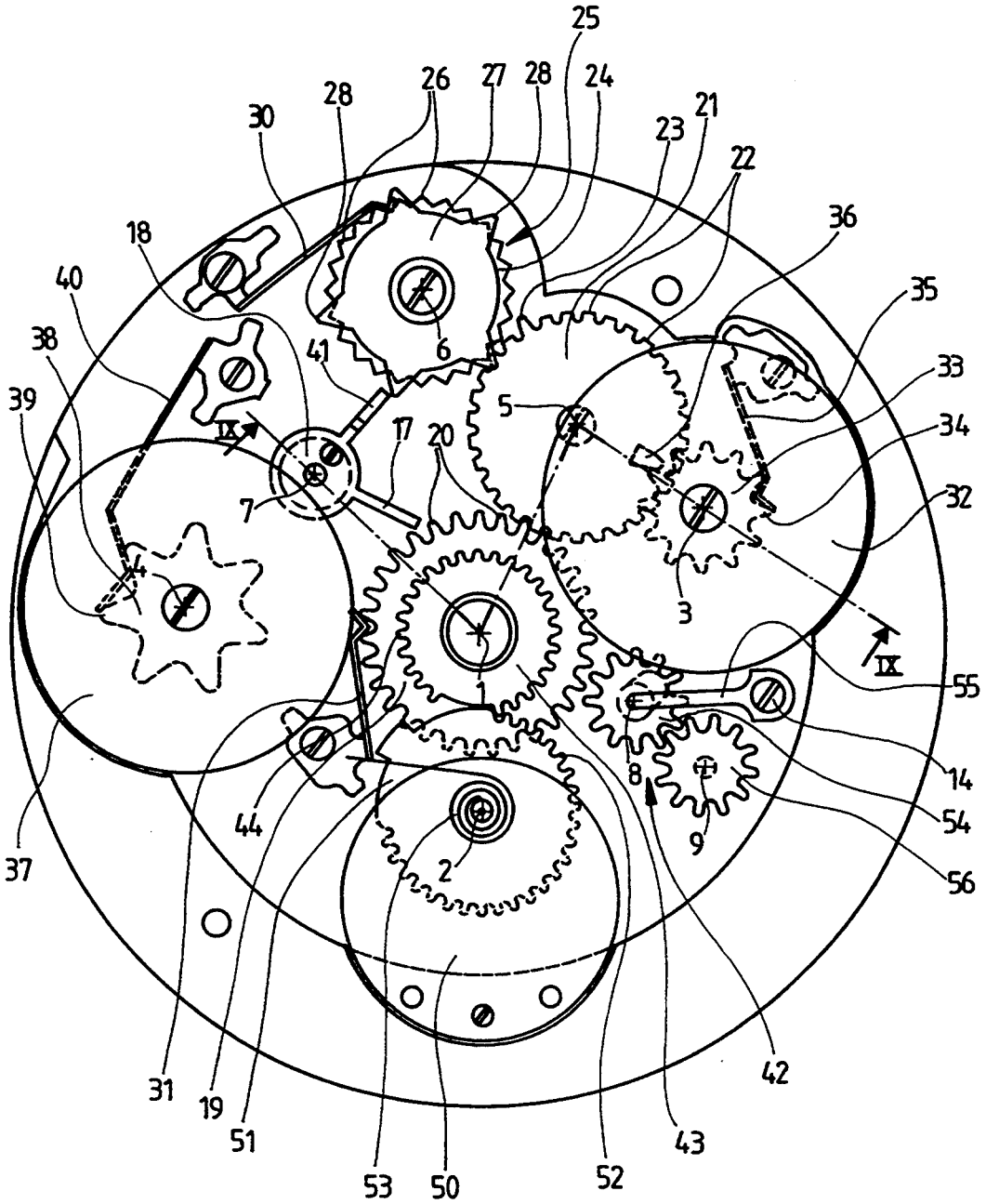
FIG. 5 is analogous to FIG. 4, the position of the wheels being that shown the 30th of April at midnight.

FIG. 5 shows the position of the mechanism on the 30th of April at midnight. Finger 41 of the driving wheel set 18 has pushed tooth 28 of the second plate 27 of the annual wheel 25 through one step, rendering such wheel 25 driving and thus pushing in its turn the non-truncated tooth 23 of the intermediate wheel 21 which advances by one step causing the date wheel 19 to advance through one step, the end of the step being assured by the jumper spring 31 coming to bear in the space between two teeth 20. The date hand displays the 31st. Finger 36 of the intermediate wheel bears against a tooth 34 of star 33 (see also the cross-section of FIG. 9). The disc 32 continues to display April. Finger 17 of the driving wheel set 18 approaches a tooth 20 of the date wheel which it is about to strike in some instants (see also cross-section of FIG. 9).

Figure 6:
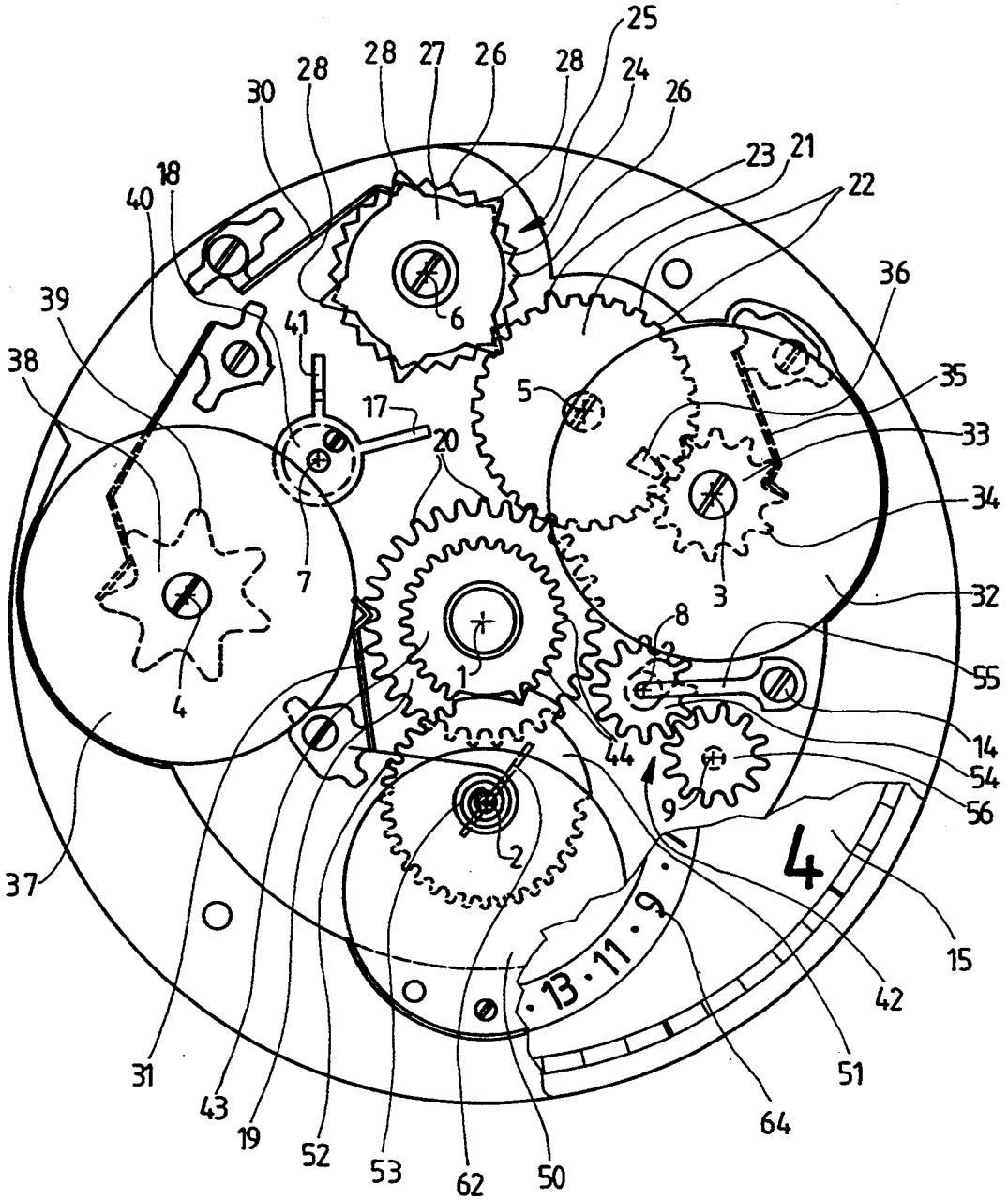
FIG. 6 is analogous to FIG. 4, the position of the wheels being that shown the 1st of May.

FIG. 6 shows the position of the mechanism the 1st of May at 20:00 hours. Finger 17 of the driver wheel set 18 has caused the date wheel to advance through one step, liberating the fly-back wheel 151 which returns to its point of departure. The date hand displays 1. In progressing through one step, the date wheel 19 has caused the intermediate wheel 21 to advance by one step, which in turn has caused the star 33 to advance through one step. The month disc displays May. Finger 17, in passing in the clockwise sense from the position which it had on FIG. 5 to the position which it occupies on FIG. 6, has not only caused the date wheel 19 to advance through a step as has just been said, but has caused the day star 38 to advance through one step, the disc 37 now displaying the following day. During the operations described with reference to FIG. 6, the annual wheel 25, not being driven, has remained stationary. FIG. 6 also shows, partially torn away, the dial 15 of the timepiece with indications 64 of the calendar. The date hand 62 is also partially suggested.

Figure 7:
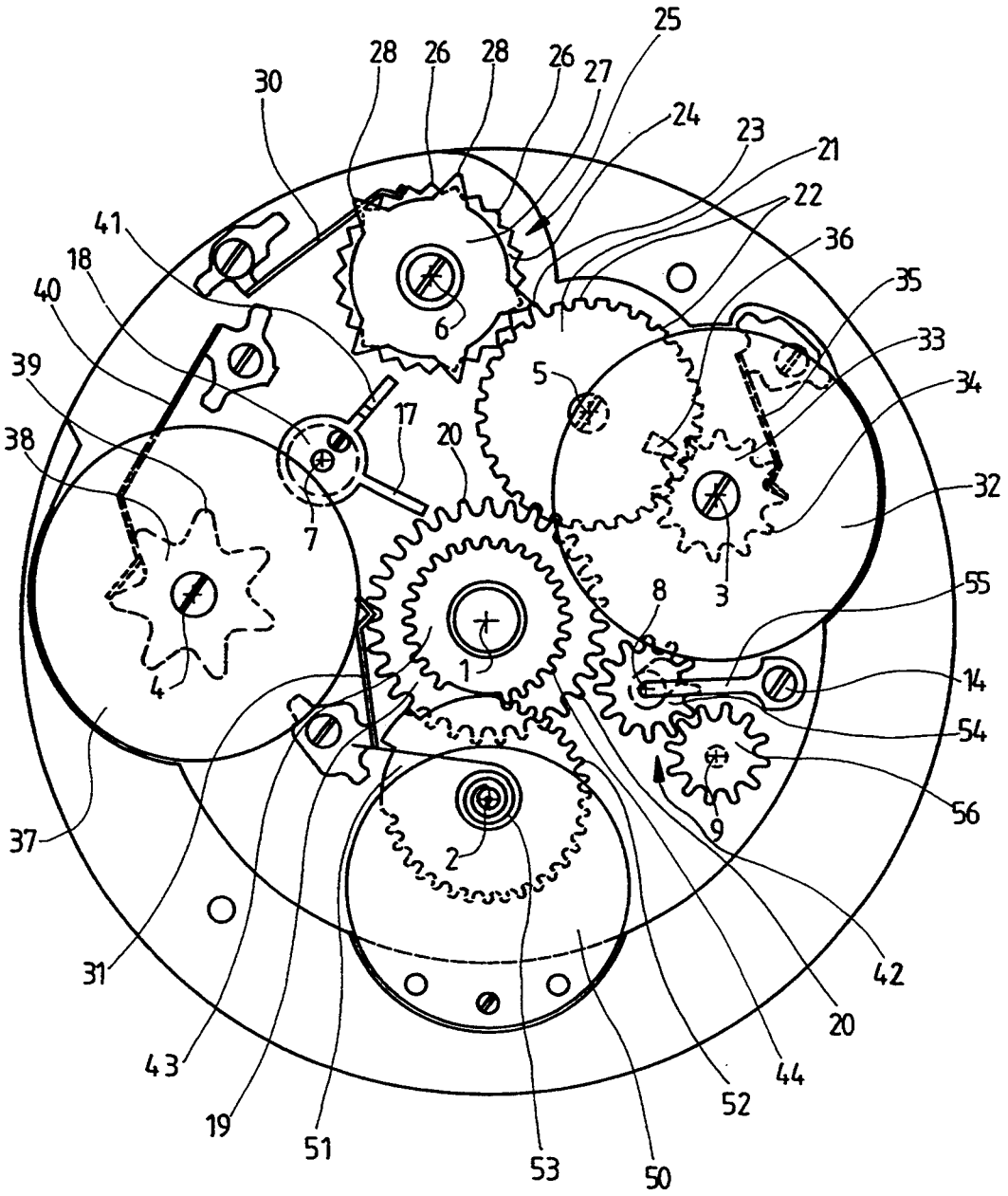
FIG. 7 is analogous to FIG. 4, the position of the wheels being that shown the 31st of May.
Figure 8:
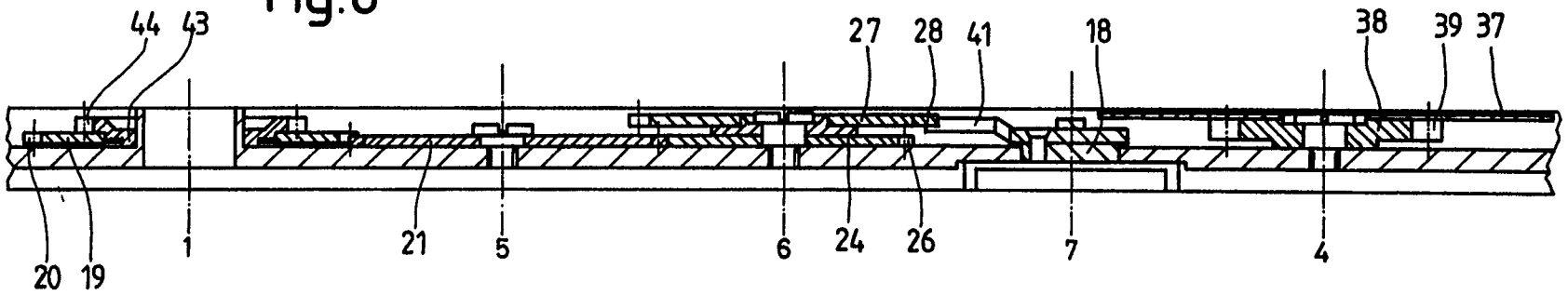
FIG. 8 is a cross-section along line VIII—VIII of FIG. 4.
Figure 9:
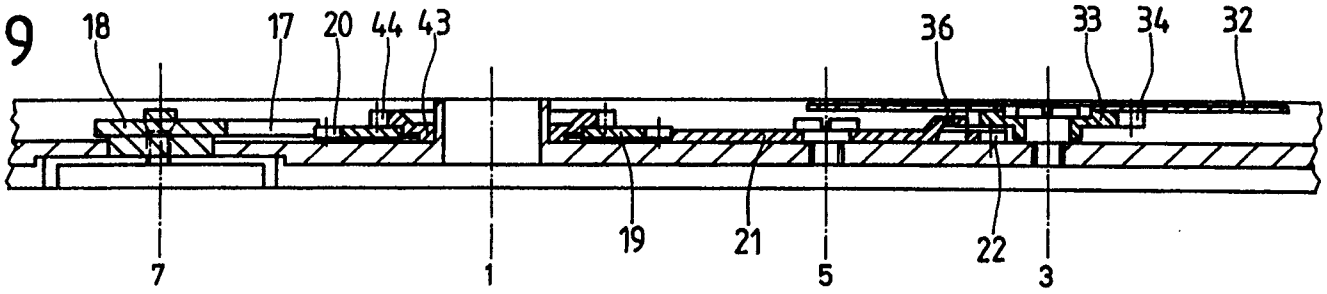
FIG. 9 is a cross-section along line IX—IX of FIG. 5.
Figure 10:
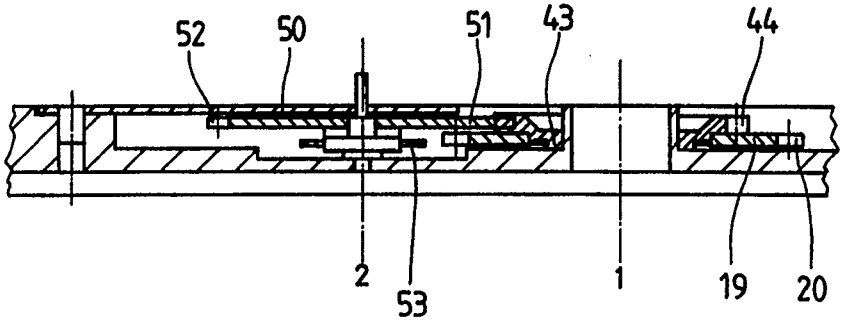
FIG. 10 is a cross-section along line X—X of FIG. 4.

FIG. 7 shows the position of the mechanism the 31st of May at midnight. The date hand displays the 31st and the finger 17 of the driver 18 is ready to push a tooth 20 of the date wheel 19 to the following date. Finger 41 has not encountered a long tooth 28 of the second plate 27 of the annual wheel 25 during its passage. Thus, for this particular month, the date hand will indicate successively the 30th and the 31st before displaying the 1st of June.

Figure 11:
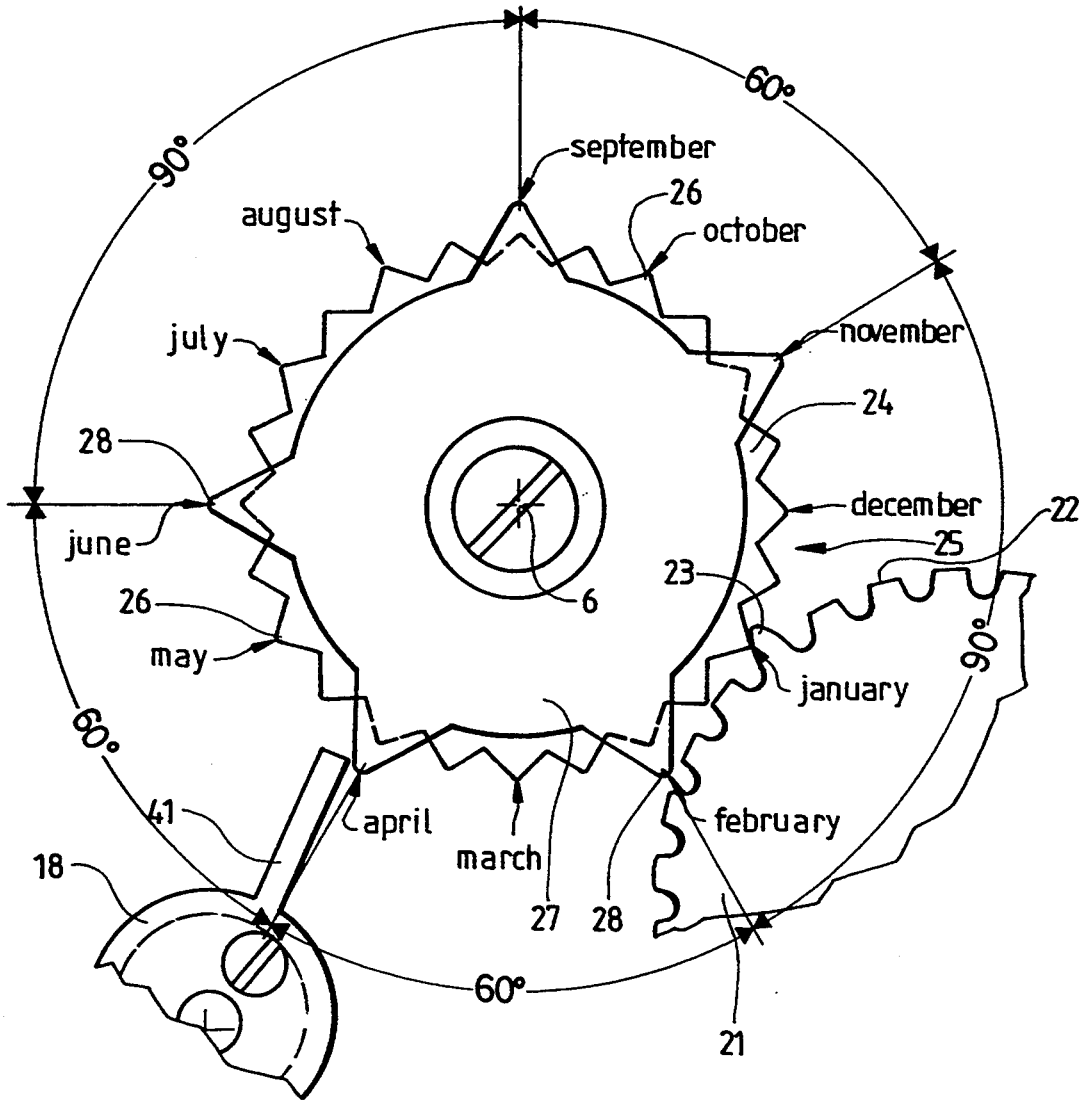
FIG. 11 is a plan view of the annual wheel of FIG. 4 which explains the function of such wheel relative to the month of the year.

FIG. 11 is a partial resumption of FIG. 4. It shows the annual wheel 25 and in part the driving wheel 18 and the intermediate wheel 21 in mesh with said annual wheel. It is noted that the long teeth 28 of the second plate 27 are placed around such plate successively at 60°, 60°, 90°, 60°, 90°. If such teeth which represent the months of February, April, June, September and November are in the path of finger 41 of the driving wheel 18, the date will pass rapidly from the 30th to the 31st, then from the 31st to the 1st of the following month, as has been explained hereinabove. At the end of the month of May, it is a short tooth 26 of the first plate 24 which is in the extension of finger 41. Accordingly, nothing happens. The months of June and of September are shown by the long teeth 28 between which are arranged the short teeth 26 which represent the months of July and of August. Likewise, the long teeth of the months of September and November (months of thirty days) are separated by the short tooth of the month of October (thirty-one day month) the cycle continuing with the months of November and of February separated by the months of December and January and ending up with the months of February and April, separated by the month of March.

To conclude, it will be mentioned that the mechanism can be completed by a wheel making one revolution in four years, resembling the annual wheel 25 and engaged therewith in order to render the system perpetual, that is to say, taking into account every year the number of days in the month of February, namely 28, or 29 should it concern a leap year.

What we claim is:

1. An annual calendar mechanism for a timepiece, such calendar displaying through a window pierced in a dial or by division marks applied to the dial to which a hand points, such mechanism including a date driver wheel set making one revolution in twenty-four hours, said wheel set being fitted with at least one finger adapted to drive a date wheel including thirty-one teeth through one step once each day, said date wheel operating the calendar display, the date wheel driving an intermediate wheel including thirty-one teeth, thirty of which are truncated, the non-truncated tooth driving a first plate of an annual wheel bearing twenty-four teeth once per month through two steps, such annual wheel comprising a second plate fixed thereto and superposed thereon bearing five teeth, each corresponding to months of less than thirty-one days, each of such teeth being arranged so as to come into the path of the finger of the date driver wheel set at the end of the cited months so as to drive the annual wheel through one step, which has as consequence the driving of the date wheel through an additional step via said intermediate wheel at the end of said months.

2. A mechanism as set forth in claim 1, a jumper spring being arranged over the teeth of the first plate of the annual wheel so as to position it angularly when it is not being actuated.

3. A mechanism as set forth in claim 1, a jumper spring being arranged over the teeth of the date wheel so as to position it angularly when it is not being actuated.

4. A mechanism as set forth in claim 1, the five teeth of the second plate of the annual wheel being arranged around said second plate successively at 60°, 60°, 90°, 60° and 90°.

5. A mechanism as set forth in claim 1, further including a months display comprising a star with twelve teeth indexed by a jumper spring, the star being actuated once per month by a finger fixed to the intermediate wheel.

6. A mechanism as set forth in claim 1, further including a day display comprising a star with seven teeth indexed by a jumper spring, the star being actuated once per day by the finger (17) borne by the date driver wheel set.

7. A mechanism as set forth in claim 1, further including a rapid corrector in engagement with the date wheel, said corrector being actuated by the crown exhibited by the timepiece.

* * * * *